US005496964A

United States Patent [19]

Suzuki

[11] Patent Number: 5,496,964

[45] Date of Patent: Mar. 5, 1996

[54] TONE GENERATOR FOR ELECTRONIC MUSICAL INSTRUMENT INCLUDING MULTIPLE FEEDBACK PATHS

[75] Inventor: Hideo Suzuki, Hamamatsu, Japan

[73] Assignee: Yamaha Corporation, Japan

[21] Appl. No.: 217,478

[22] Filed: Mar. 24, 1994

[30] Foreign Application Priority Data

Mar. 26, 1993 [JP] Japan ..... 5-068872

[51] Int. Cl.[6] ..... G10H 1/08; G10H 1/12

[52] U.S. Cl. ..... 84/660; 84/661; 84/DIG. 9; 84/DIG. 10

[58] Field of Search ..... 84/622–625, 659–661, 84/DIG. 9, DIG. 10

[56] References Cited

U.S. PATENT DOCUMENTS

| | | | |
|---|---|---|---|
| 5,223,657 | 6/1993 | Takeuchi . | |
| 5,290,969 | 3/1994 | Kobayashi | 84/DIG. 10 |
| 5,308,918 | 3/1994 | Yamauchi et al. | 84/661 X |
| 5,352,849 | 10/1994 | Kobayashi et al. | 84/DIG. 10 |
| 5,382,751 | 1/1995 | Kitayama et al. | 84/661 |

FOREIGN PATENT DOCUMENTS 58-48109 10/1983 Japan .

*Primary Examiner*—Stanley J. Witkowski
*Attorney, Agent, or Firm*—Graham & James

[57] ABSTRACT

A tone generator for an electronic musical instrument is fundamentally configured by a drive-waveform creating portion and a closed loop. The drive-waveform creating portion creates a drive-waveform signal by mixing an excitation waveform and a noise waveform together. The drive-waveform signal is applied to the closed loop through an adder. The closed loop contains a plurality of feedback paths, each of which at least contains a delay circuit and an all-pass filter. The adder adds all of output signals of the feedback paths together with the drive-waveform signal so as to produce a musical tone signal. The number of delay stages, representing an amount of delay to be used in each delay circuit provided in each feedback path, is designated in response to a delay ratio which is arbitrarily set. Since the signal repeatedly circulates through the closed loop containing a plurality of feedback paths, each having a specific signal processing function, the musical tone signal to be produced has a rich amount of overtone components.

7 Claims, 5 Drawing Sheets

TONE GENERATOR FOR ELECTRONIC MUSICAL INSTRUMENT INCLUDING MULTIPLE FEEDBACK PATHS

BACKGROUND OF THE INVENTION

1. Field of the Invention

The present invention relates to a tone generator for an electronic musical instrument, and more particularly to a delay-feedback-type tone generator.

2. Prior Art

The tone generator, which is conventionally used for the electronic musical instrument, employs a mixing method utilizing a frequency modulation. According to this mixing method, a frequency modulation is performed on signals, which represent sine waves and are read from memories, so as to create overtone components. The sounds which are obtained by performing the above-mentioned mixing method may be heard as if they are monotonous, or mathematically mixed. In short, it is difficult to create the sounds, whose properties are similar to those of the acoustic sounds, by using the above mixing method. Thus, the recent technology has developed a new musical tone synthesizing apparatus which instead of using the modulation when mixing the waveforms, activates a physical model simulating a tone-generation mechanism of an acoustic musical instrument. This kind of apparatus has been disclosed in Japanese Patent Publication No. 58-48109, for example. In this apparatus, there is provided a loop circuit which contains a delay circuit and a filter and to which a signal, such as an impulse signal, representing an initial waveform containing a plenty of frequency components is applied. Then, the signal circulating through the loop circuit is extracted as a musical tone signal. According to the above-mentioned apparatus, every time the initial-waveform signal applied to the loop circuit passes through the filter, the certain frequency characteristic is imparted to the initial-waveform signal by the filter. Due to such frequency characteristic, certain frequency components, included in the initial-waveform signal, are attenuated. As a result, it is possible to obtain an attenuating sound from the output of the loop circuit, wherein the attenuating sound is a sound whose level is attenuated in a lapse of time and whose tone color is altered in a lapse of time.

The tone generator conventionally known suffers from a problem that the overtone components become monotonous or are artificially regularized. In other words, this tone generator is not suitable for synthesizing the musical tones whose properties are similar to those of the acoustic sounds so that the tone color is altered in a complex manner.

SUMMARY OF THE INVENTION

It is an object of the present invention to provide a tone generator for an electronic musical instrument which is capable of generating the musical tones whose property is as complex as the acoustic sounds.

According to a fundamental configuration of the present invention, a tone generator for an electronic musical instrument is configured by a drive waveform creating portion and a closed loop. The drive waveform creating portion creates a drive-waveform signal by mixing an excitation waveform and a noise waveform together. The drive-waveform signal is applied to the closed loop through an adder. The closed loop contains a plurality of feedback paths, each of which at least contains a delay circuit and an all-pass filter. The adder adds all of output signals of the feedback paths together with the drive-waveform signal so as to produce a musical tone signal.

The number of delay stages, representing an amount of delay to be used in each delay circuit provided in each feedback path, is designated in response to a delay ratio which is arbitrarily set.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings.

DESCRIPTION OF THE PREFERRED EMBODIMENTS

Figure 1:
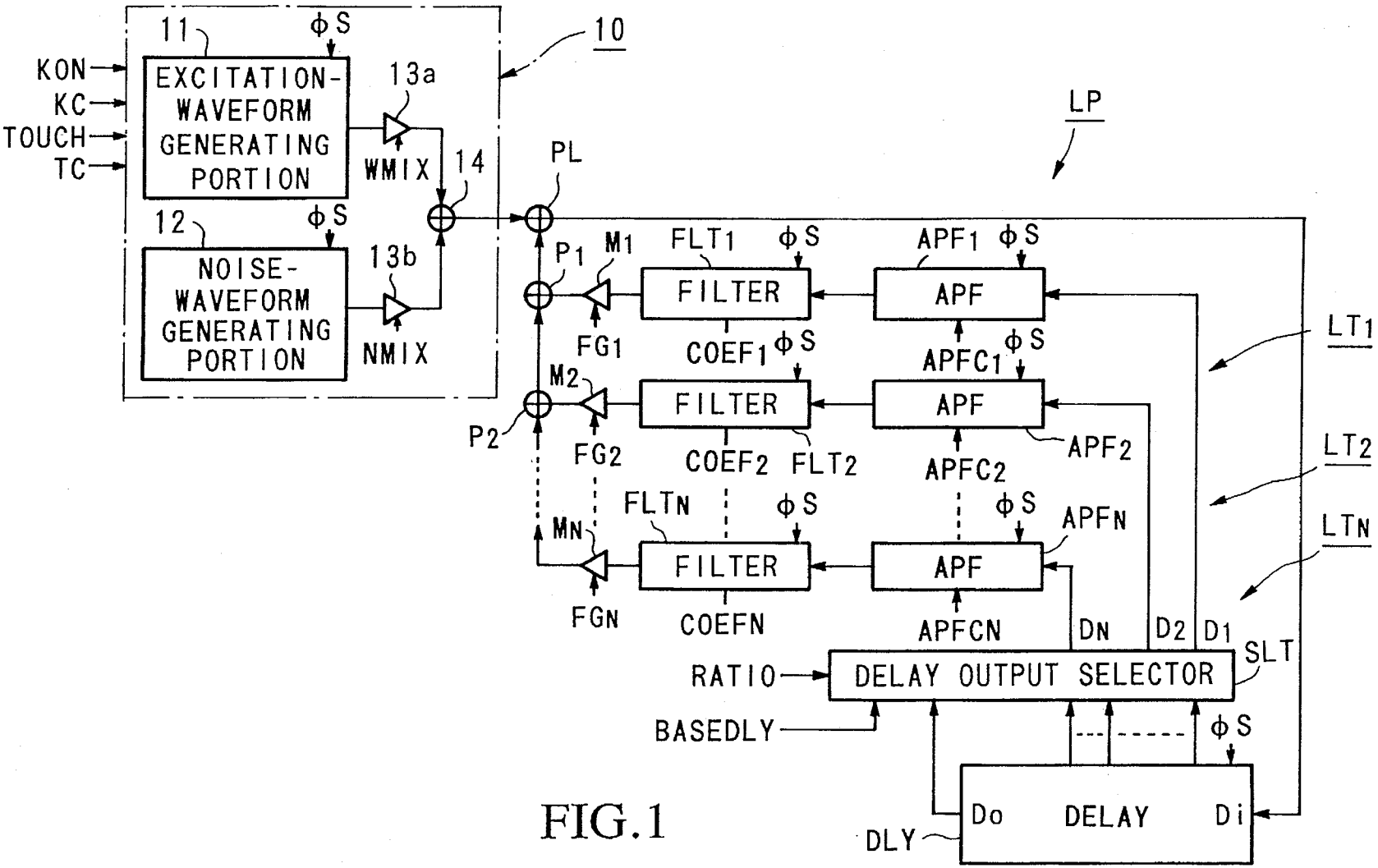
FIG. 1 is a block diagram showing a tone generator according to a first embodiment of the present invention.

Now, embodiments of the present invention will be described in detail by referring to the drawings.

[A] First embodiment

(1) Hardware configuration

FIG. 1 is a block diagram showing a tone generator, applied for the electronic musical Instrument, which is designed in accordance with the first embodiment of the present invention. In FIG. 1, a numeral 10 denotes a drive-waveform creating portion, which is configured by an excitation-waveform generating portion 11, a noise-waveform generating portion 12, multipliers 13*a*, 13*b* and an adder 14. The drive-waveform creating portion 10 receives several kinds of signals which are produced by performing a manual operation on a manual-operable member, such as a key of the keyboard (not shown).

In short, the drive-waveform creating portion 10 receives four kinds of signals as follows:

① a keycode KC representing a tone pitch of a key depressed;

② a key-on signal KON indicating that a key-depressing operation is performed on the key of the keyboard;

③ touch information TOUCH representing a touch response which is obtained when depressing the key; and ④ tone-color information TC corresponding to the tone color which is set in advance.

The excitation-waveform generating portion 11 stores plural kinds of excitation waveforms. Herein, one period of each excitation waveform is stored in the excitation-waveform generating portion 11. One of the excitation waveforms is selected responsive to the tone-color information TC. Then, the keycode KC is used to determine the frequency for the excitation waveform currently selected, while the touch information TOUCH is used to determine the amplitude for the excitation waveform currently selected. When receiving the key-on signal KON, the excitation-waveform generating portion 11 generates instantaneous values of the selected excitation waveform whose frequency and amplitude are determined as described above. In synchronism with sampling clocks $\phi$s, those Instantaneous values are sequentially outputted from the excitation-waveform generating portion 11.

The noise-waveform generating portion 12 outputs a noise waveform, corresponding to the tone-color information TC, with an amplitude corresponding to the touch information TOUCH. In synchronism with the sampling clocks $\phi$s, instantaneous values of the noise waveform are sequentially outputted from the noise-waveform generating portion 12. The instantaneous values of the excitation waveform outputted from the excitation-waveform generating portion 11 are multiplied by a weighted coefficient WMIX by the multiplier 13*a*. The instantaneous values of the noise waveform outputted from the noise-waveform generating portion 12 are multiplied by a weighted coefficient NMIX by the multiplier 13*b*. Those weighted coefficients WMIX and NMIX are outputted from a control circuit (not shown) on the basis of the tone color which is set in advance. Then, results of multiplication respectively obtained from the multipliers 13*a* and 13*b* are added together by the adder 14.

A delay circuit DLY is configured by a plurality of cells or shift registers, for example. Every time the delay circuit DLY receives each of the sampling clocks $\phi$s, a musical tone signal, which is firstly applied to an input terminal Di, is shifted from a former-stage cell to a latter-stage cell. An amount of delay imparted to the musical tone signal depends upon which cell of the delay circuit DLY the musical tone signal is extracted. In the present embodiment, the amount of delay is determined by a number of cells through which the musical tone signal passes. When needing a decimal-fraction-stage delay cell other than an integral-stage delay cell, an interpolation circuit or an all-pass filter is used, which will be described later. In the present embodiment, the amount of delay imparted to the musical tone signal which is extracted from the latter-stage delay cell is larger than the amount of delay imparted to the musical tone signal which is extracted from the former-stage delay cell. In other words, as the number of delay cells through which the musical tone signal passes becomes larger, the amount of delay to be imparted to the musical tone signal becomes larger. In the delay circuit DLY, the shift registers can be replaced by a random-access memory (i.e., RAM). In this case, a read time for reading the musical tone signal from the RAM is shifted from a write time for writing the musical tone signal into the RAM by a predetermined period of time. Then, by controlling a difference of time between the read time and write time, it is possible to impart a desired delay time to the musical tone signal. In the delay circuit DLY, the musical tone signal which is firstly applied to the input terminal Di is delayed by the certain amount of delay in response to the number of delay cells through which the musical tone signal passes. Then, the delayed signals outputted from respective cells of the delay circuit DLY are supplied to a delay output selector SLT.

The delay output selector SLT selects one of the delayed signals supplied thereto as each of musical tone signals $D_1$ to $D_N$, each of which is delayed behind the original musical tone signal by a certain delay time. Each of those musical tone signals $D_1$ to $D_N$ is supplied to each of all-pass filters $APF_1$ to $APF_N$. The all-pass filters $APF_1$ to $APF_N$ respectively receive filter coefficients $APFC_1$ to $APFC_N$, which are determined by the tone color. Based on the all-pass filter coefficient, the phase characteristic of the all-pass filter is controlled. Hence, each all-pass filter performs an all-pass filtering operation on the input signal thereof in synchronism with the sampling clock $\phi$s. Output signals of the all-pass filters $APF_1$ to $APF_N$ are respectively supplied to filters $FLT_1$ to $FLT_N$. Each of the filters $FLT_1$ to $FLT_N$ is controlled in the frequency characteristic thereof on the basis of each of filter coefficients $COEF_1$ to $COEF_N$, which are determined by the tone color. Hence, each filter performs a filtering operation on the input signal thereof in synchronism with the sampling clock $\phi$s. Filtered signals respectively outputted from the filters $FLT_1$ to $FLT_N$ are supplied to multipliers $M_1$ to $M_N$ respectively. The multipliers $M_1$ to $M_N$ receive attenuation coefficients $FG_1$ to $FG_N$. By being multiplied by the attenuation coefficient, the filtered signal supplied to each multiplier is attenuated. As the attenuation coefficient, it is possible to employ a certain value corresponding to the tone color which is set in advance, or it is possible to employ another value which can be independently set, regardless of the tone color. Output signals of the multipliers $M_1$ to $M_{N-1}$ are respectively supplied to adders $P_1$ to $P_{N-1}$, while an output signal of the multiplier $M_N$ is also supplied to the adder $P_{N-1}$ (not shown). Herein, the adder $P_1$ adds the output signal of the multiplier $M_1$ to an output signal of the adder $P_2$, while the adder $P_2$ adds the output signal of the multiplier $M_2$ to an output signal of the adder $P_3$, whereas the adder $P_{N-1}$ adds the output signals of the multipliers $M_{N-1}$ and $M_N$ together. Then, an output signal of the adder $P_1$ is supplied to an adder PL.

The adder PL adds the output signals of the adders $P_1$ and 14 together; and then, a result of addition is outputted as the musical tone signal, which is also supplied to the aforementioned delay circuit DLY. Meanwhile, feedback paths $LT_1$ to $LT_N$ are formed by the delay circuit DLY, the delay output selector SLT, the all-pass filters $APF_1$ to $APF_N$, the filters $FLT_1$ to $FLT_N$, the multipliers $M_1$ to $M_N$ and the adders $P_1$ to $P_{N-1}$ respectively. More specifically, the feedback path $LT_1$ is formed by the delay cells of the delay circuit DLY, the delay output selector SLT, the all-pass filter $APF_1$, the filter $FLT_1$, the multiplier $M_1$ and the adder $P_1$; the feedback path $LT_2$ is formed by the delay cells of the delay circuit DLY, the delay output selector SLT, the all-pass filter $APF_2$, the filter $FLT_2$, the multiplier $M_2$ and the adder $P_2$; and, the feedback path $LT_N$ is formed by the delay cells of the delay circuit DLY, the delay output selector SLT, the all-pass filter $APF_N$, the filter $FLT_N$ and the multiplier $M_N$. The data outputted from the adder PL is fed back to the adder PL through each feedback path. By being circulated through each of the feedback paths $LT_1$ to $LT_N$, the resonance is effected on the musical tone signal. The adder PL and the above-mentioned feedback paths $LT_1$ to $LT_N$ are assembled together to form a closed loop LP as a whole. Hence, the signal circulates through the closed loop LP is extracted as the musical tone signal.

Figure 2:
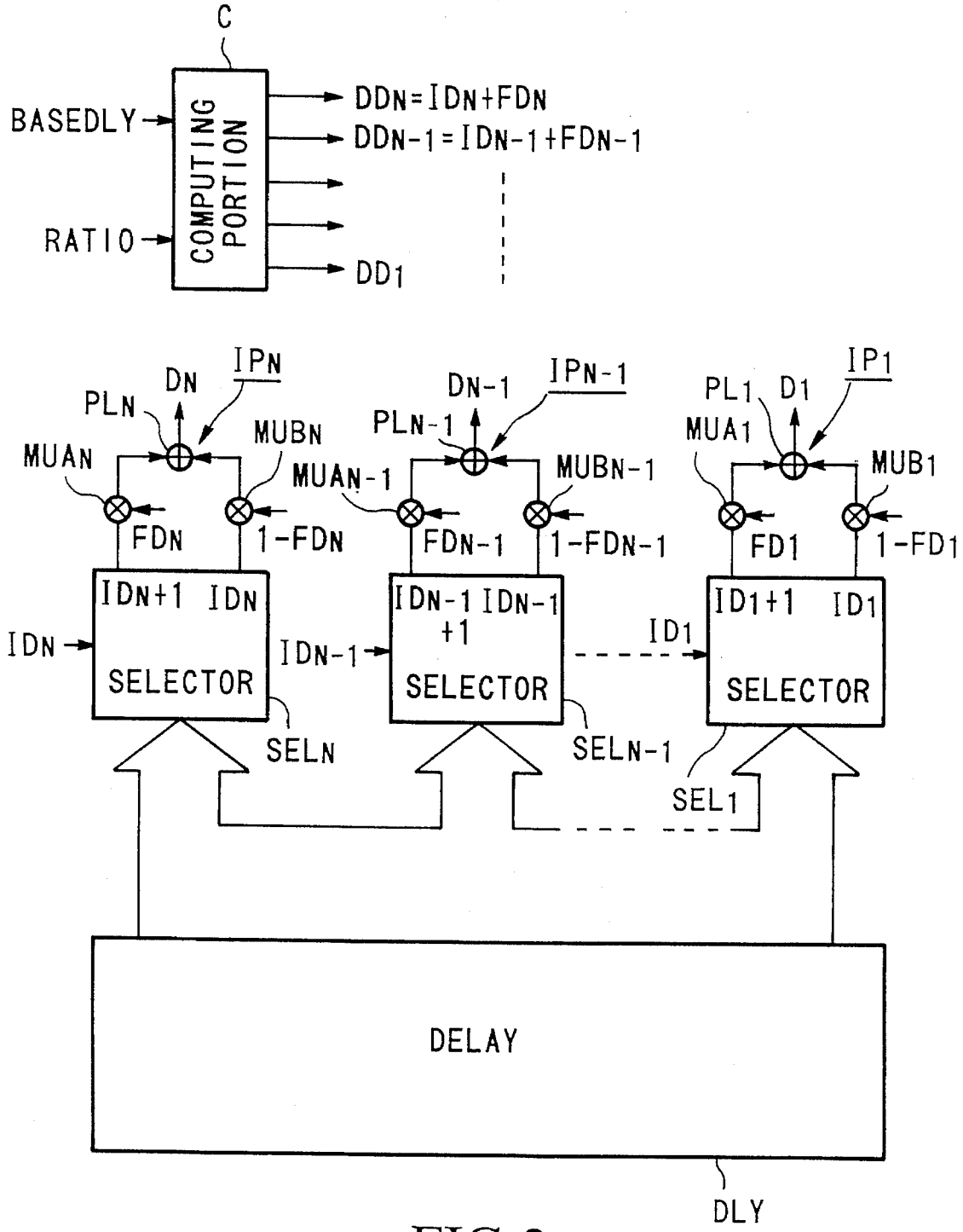
FIG. 2 is a block diagram showing a detailed configuration of a delay output selector shown in FIG. 1.

Now, a detailed configuration of the delay output selector SLT will be described by referring to FIG. 2. The delay output selector SLT is basically configured by a computing portion C, selector portions $SEL_1$ to $SEL_N$ and Interpolation portions $IP_1$ to $IP_N$. The computing portion C inputs two kinds of data, denoted by symbols "RATIO" and "BASEDLY", which are created responsive to manual operations applied to manual-operable members (not shown). Herein, "RATIO" designates a delay ratio which is determined by the tone-color information TC, while "BASEDLY" designates a base delay which is determined by the keycode KC and its corresponding tone-pitch information PITCH. The delay ratio RATIO represents a ratio among the delay times respectively applied to the feedback paths $LT_1$ to $LT_N$. In addition, the base delay BASEDLY designates the longest delay time among the delay times of the feedback paths $LT_1$ to $LT_N$ in connection with each tone pitch.

Next, operations of each portion in the delay output selector SLT will be described in detail.

(a) Computing portion C

The computing portion C computes a number of delay stages, denoted by each of symbols $DL_1$ to $DL_N$, with respect to each of the feedback paths $LT_1$ to $LT_N$ on the basis of the base delay BASEDLY and the delay ratio RATIO. For example, a ratio among the delay times of the feedback paths $LT_1$ to $LT_N$ is set as follows:

$$1 : a_{N-1} : a_{N-2} : \ldots : a_1$$

In this case, the number of delay stages is computed with respect to each of the feedback paths $LT_N$ to $LT_1$ as follows:

$$DL_N = BASEDLY;$$

$$DL_{N-1} = a_{N-1} * BASEDLY; \ldots$$

$$DL_1 = a_1 * BASEDLY.$$

Thereafter, the computing portion C performs another computation to remove the amount of delay, corresponding to each of the filters $FLT_1$ to $FLT_N$, from the amount of delay (i.e., the number of delay stages) which is computed as described above with respect to each of the feedback paths $LT_1$ to $LT_N$. Then, results of computation $DD_N$ to $DD_1$ are obtained with respect to the feedback paths $LT_N$ to $LT_1$ respectively, wherein $DD_N$ to $DD_1$ are represented as follows:

$$DD_N = DL_N - tf_N;$$

$$DD_{N-1} = DL_{N-1} - tf_{N-1}; \ldots$$

$$DD_1 = DL_1 - tf_1.$$

In the above equations, symbols $tf_N$ to $tf_1$ are equivalent values representing the numbers of delay stages of the filters $FLT_N$ to $FLT_1$ which are respectively provided in the feedback paths $LT_N$ to $LT_1$. Each of the numbers of delay stages $DD_1$ to $DD_N$ consists of an integral part and a decimal part. More specifically, the number of delay stages $DD_1$ consists of an integral part $ID_1$ and a decimal part $FD_1$, while the number of delay stages $DD_N$ consists of an integral part $ID_N$ and a decimal part $FD_N$. The integral parts $ID_1$ to $ID_N$ are respectively supplied to the selector portions $SEL_1$ to $SEL_N$, while the decimal parts $FD_1$ to $FD_N$ are respectively supplied to the interpolation portions $IP_1$ to $IP_N$.

(b) Selector portions $SEL_1$ to $SEL_N$

The selector portions $SEL_1$ to $SEL_N$ respectively receive the output signals of the respective cells of the delay circuit DLY. Each of the selector portions $SEL_1$ to $SEL_N$ is activated to output the delayed musical tone signal which is outputted from the cell, designated by each of the integral parts $ID_1$ to $ID_N$, in the delay circuit DLY. Each selector portion receives the output signals of the two cells of the delay circuit. The selector portion $SEL_1$ receives the output signals of the two cells respectively designated by the integral numbers $ID_1$ and $ID_1+1$; hence, each of those output signals is selected in accordance with the integral part $ID_1$. The selector portion $SEL_{N-1}$ receives the output signals of the two cells respectively designated by the integral numbers $ID_{N-1}$ and $ID_{N-1}+1$; hence, one of those output signals is selected in accordance with the integral part $ID_{N-1}$. Similarly, the selector portion $SEL_N$ receives the output signals of the two cells respectively designated by the integral numbers $ID_N$ and $ID_N+1$; hence, one of those output signals is selected in accordance with the integral part $ID_N$.

(c) Interpolation portion $IP_1$ to $IP_N$

Each of the interpolation portions $IP_1$ to $IP_N$ is configured by one adder and two multipliers. In FIG. 2, the interpolation portion $IP_1$ is configured by an adder PL1 and multipliers $MUA_1$, $MUB_1$; the interpolation portion $IP_{N-1}$ is configured by an adder $PL_{N-1}$ and multipliers $MUA_{N-1}$, $MUB_{N-1}$; and the interpolation portion $IP_N$ is configured by an adder $PL_N$ and multipliers $MUA_N$, $MUB_N$. Based on each of the decimal parts $FD_1$ to $FD_N$ of the numbers of delay stages $DD_1$ to $DD_N$ outputted from the computing portion C, each of the interpolation portions $IP_1$ to $IP_N$ performs an interpolation operation on the amount of delay imparted to the delayed musical tone signal which is selectively outputted from each of the selector portions $SEL_1$ to $SEL_N$. For example, when the computing portion C outputs the number of delay stages $DD_N$, the selector $SEL_N$ is selectively activated, so that the output signals of the two cells respectively designated by the integral numbers $ID_N$ and $ID_N+1$ are supplied to the selector $SEL_N$. In this case, the multiplier $MUA_N$ multiplies the output signal of the cell designated by the integral number $ID_N+1$ by the value of the decimal part $FD_N$, while the multiplier $MUB_N$ multiplies the output signal of the cell designated by the integral number $ID_N$ by a value "$1-FD_N$". Then, results of multiplication respectively obtained from the multipliers $MUA_N$ and $MUB_N$ are added together by the adder $PL_N$, so that a result of addition is outputted from the interpolation portion $IP_N$ as the output signal $D_N$ which is used in the feedback path $LT_N$.

(2) Operations

Next, several kinds of operations of the first embodiment will be described in detail.

(a) Tone-color setting operation

When the performer operates the tone-color setting switches (not shown) to set the tone color, the control portion (not shown) produces and outputs the tone-color information TC corresponding to the set tone color. In response to the tone color which is set by the performer, the control portion also produces and outputs the weighted coefficients WMIX, NMIX, the filter coefficients $APFC_1$–$APFC_N$, $COEF_1$–$COEF_N$ and the attenuation coefficients $FG_1$–$FG_N$. Then, the delay ratio RATIO which is determined on the basis of the tone-color information TC is supplied to the delay output selector SLT.

(b) Tone-generation instruction

Next, when the key of the keyboard (not shown) is depressed, the control portion detects the keycode KC so as to produce its key-on signal KON. In addition, the tone-pitch information PITCH is also produced based on the keycode KC. Further, the touch information TOUCH representing the touch response of the key currently depressed is produced simultaneously. Then, the base delay BASEDLY which is determined on the basis of the keycode KC is supplied to the delay output selector SLT.

(c) Formation of musical tones

When receiving the key-on signal KON, the excitation-waveform generating portion 11 selectively outputs the excitation waveform which corresponds to the tone-color information TC. Herein, the frequency of the excitation waveform which is outputted from the excitation-waveform generating portion 11 is determined by the keycode KC, while the amplitude of the excitation waveform is determined by the touch information TOUCH. Each of the instantaneous values of the excitation waveform is sent to the multiplier 13*a* from the excitation-waveform generating portion 11 in synchronism with each of the sampling clocks ϕs. Meanwhile, when receiving the key-on signal KON, the noise-waveform generating portion 12 selectively outputs the noise waveform which corresponds to the tone-color information TC. The amplitude of the noise waveform which is outputted from the noise-waveform generating portion 12 is determined by the touch information TOUCH. Each of the instantaneous values of the noise waveform is sent to the multiplier 13*b* from the noise-waveform generating portion 12 in synchronism with each of the sampling clocks ϕs. The multiplier 13*a* multiplies the output values of the excitation-waveform generating portion 11 by the weighted coefficient WMIX, while the multiplier 13*b* multiplies the output values of the noise-waveform generating portion 12 by the weighted coefficient NMIX. The output signals of the multipliers 13*a* and 13*b* are added together by the adder 14, from which data representing the initial waveform are produced and are supplied to the adder PL. The output signal of the adder PL is extracted as the musical tone signal and is also supplied to the delay circuit DLY.

In the delay circuit DLY, the input signal is delayed by a certain delay time corresponding to a multiple of the period of the sampling clock ϕs. Incidentally, the aforementioned feedback path $LT_N$ is provided for the fundamental-tone component of the musical tone to be produced, while the other feedback paths $LT_1$ to $LT_{N-1}$ are respectively provided for the overtone components of the musical tone to be produced. The delay output selector SLT is activated in response to the delay ratio RATIO and the base delay BASEDLY, so that the number of delay stages "$DD_N$" to be used for the feedback path $LT_N$ is determined, while the numbers of delay stages "$DD_1$" to "$DD_{N-1}$" to be used for the feedback paths $LT_1$ to $LT_{N-1}$ respectively are also determined. Then, the delayed musical tone signals $D_1$ to $D_N$ which are respectively delayed by the numbers of delay stages $DD_1$ to $DD_N$ are outputted for the feedback paths $LT_1$ to $LT_N$ respectively from the delay output selector SLT.

The all-pass filter $APF_1$ alters the phase of the delayed musical tone signal $D_1$. The higher-frequency components are removed from the output signal of the all-pass filter $APF_1$ by the filter $FLT_1$. The output signal of the filter $FLT_1$ is multiplied by the attenuation coefficient $FG_1$ by the multiplier $M_1$; and then, the output signal of the multiplier $M_1$ is supplied to the adder $P_1$. Similarly, the delayed musical tone signal $D_2$ passes through the all-pass filter $APF_2$, the filter $FLT_2$ and the multiplier $M_2$; and then, the signal is finally supplied to the adder $P_2$. The delayed musical tone signal $D_N$ passes through the all-pass filter $APF_N$, the filter $FLT_N$ and the multiplier $M_N$; and then, the signal is finally supplied to the adder $P_{N-1}$ in which it is added with the output signal of the multiplier $M_{N-1}$. The result of addition of the adder $P_2$ is added with the output signal of the multiplier $M_1$ by the adder $P_1$; and then, the result of addition of the adder $P_1$ is supplied to the adder PL. Thereafter, the adder PL adds the output signals of the adders 14 and $P_1$ together; and then, the result of addition of the adder PL is supplied to the delay circuit DLY again. The above-mentioned circulating operations are repeatedly performed. As the circulating operations are repeated, the initial waveform is attenuated gradually. As the signal circulates through the closed loop LP by means of the feedback paths $LT_1$ to $LT_N$, the resonating effect is imparted to the musical tone signal. The signals which respectively pass through the feedback paths $LT_1$ to $LT_N$ are added together to form the musical tone signal, which is then fed back to the feedback paths $LT_1$ to $LT_N$; and finally, the musical tone signal is extracted from the closed loop LT. Incidentally, the overtone structure of the musical tone to be produced can be altered by changing the attenuation coefficients $FG_1$–$FG_N$ and the filter coefficients $APFC_1$–$APFC_N$, $COEF_1$–$COEF_N$.

Figure 3:
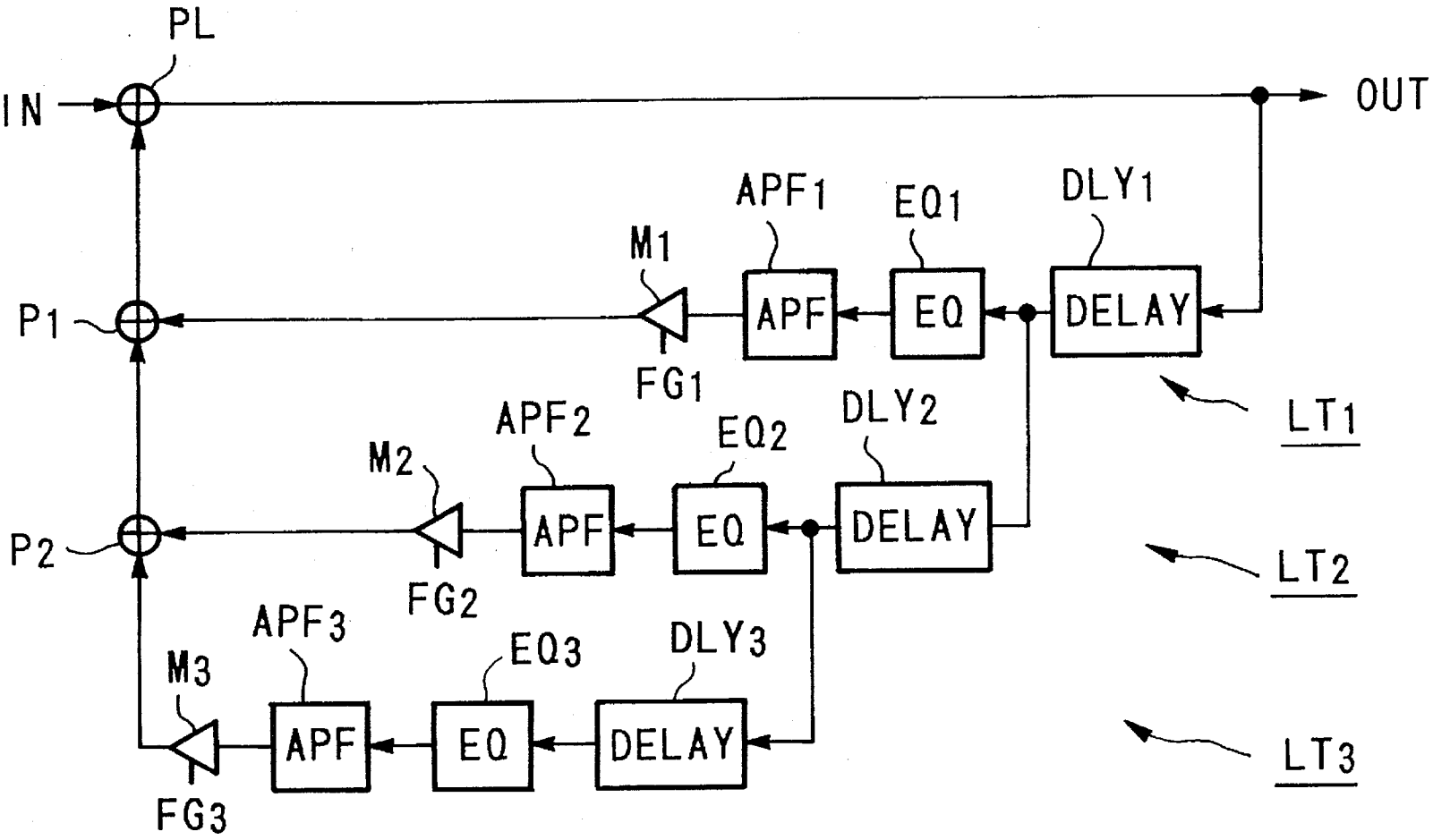
FIG. 3 is a block diagram showing another example of a closed loop which can be employed in the tone generator.

If the number of delay stages applied to each feedback path is determined in advance in the first embodiment, the closed loop LT shown in FIG. 1 can be simplified as shown in FIG. 3. In FIG. 3, there are provided three feedback paths $LT_1$ to $LT_3$. Those feedback paths $LT_1$ to $LT_3$ provide delay circuit $DLY_1$ to $DLY_3$ respectively, each of which has the predetermined number of delay stages. Further, an output signal of the delay circuit $DLY_1$ is delivered to the delay circuit $DLY_2$, while an output signal of the delay circuit $DLY_2$ is delivered to the delay circuit $DLY_3$. Thus, the ratio among the delay times of the delay circuits $DLY_1$ to $DLY_3$ can be set as follows: "2:1:1", for example. Each of the all-pass filters $APF_1$ to $APF_3$ works to alter the amount of delay of each of the feedback paths $LT_1$ to $LT_3$ in response to the frequency of the signal passing therethrough. Incidentally, each of symbols $EQ_1$ to $EQ_3$ denotes a filter (or filters) which increases or decreases the signal level in the specific frequency range. In FIG. 3, the number of the feedback paths is set at three; however, it is possible to increase the number of the feedback paths. By increasing the number of feedback paths provided in the closed loop, it is possible to synthesize the musical tones whose properties are more complex.

In the first embodiment described heretofore, each of the all-pass filters $APF_1$–$APF_N$ is independently provided; each of the filters $FLT_1$–$FLT_N$ is independently provided; and, each of the multipliers $M_1$–$M_N$ is provided independently. However, it is possible to re-design the first embodiment such that the common hardware portion is provided for each of those circuit elements. In that case, the hardware portion is designed to operate in a time-division manner.

[B] Second embodiment

Figure 4:
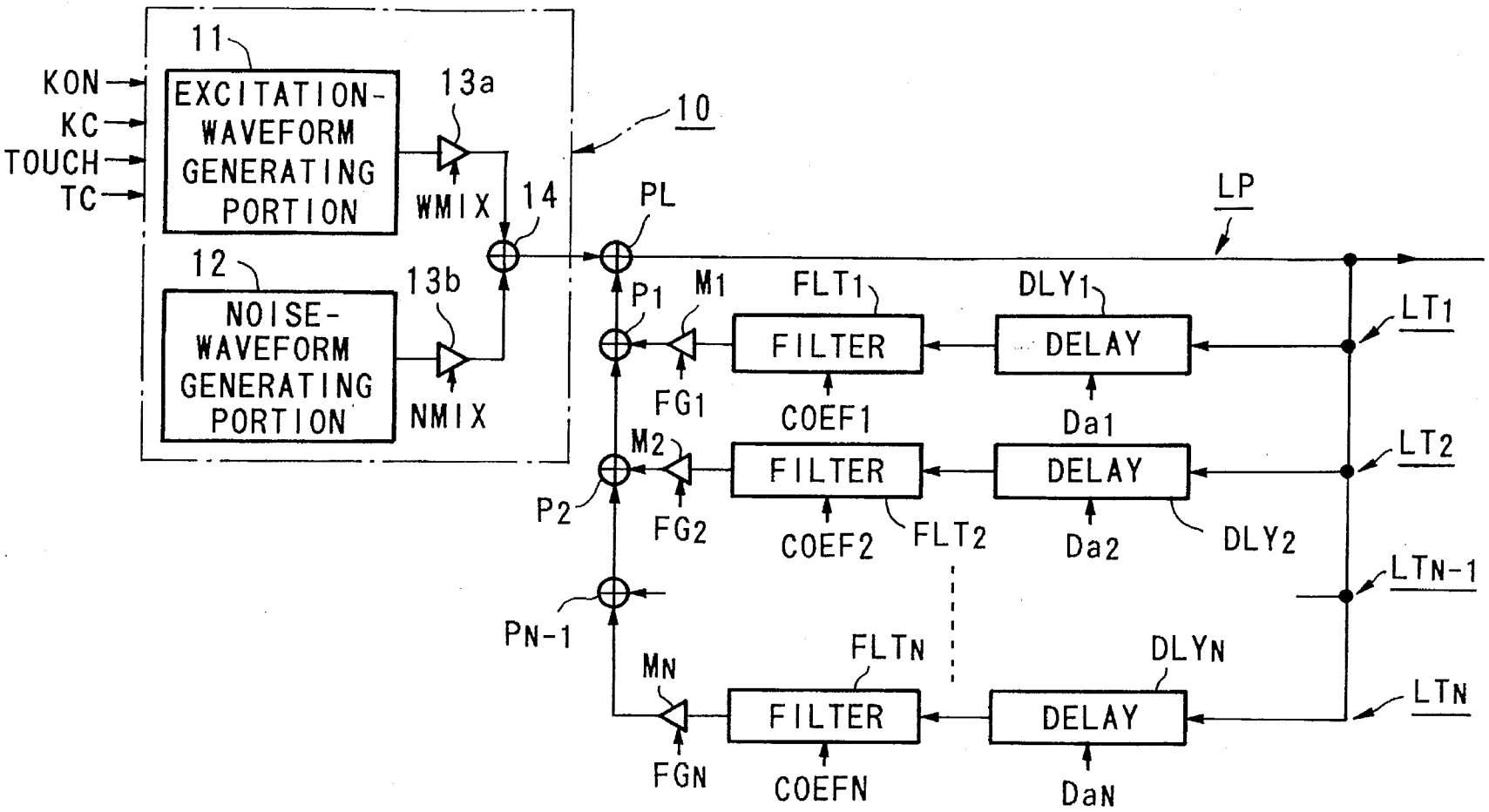
FIG. 4 is a block diagram showing a tone generator according to a second embodiment of the present invention.
Figure 5:
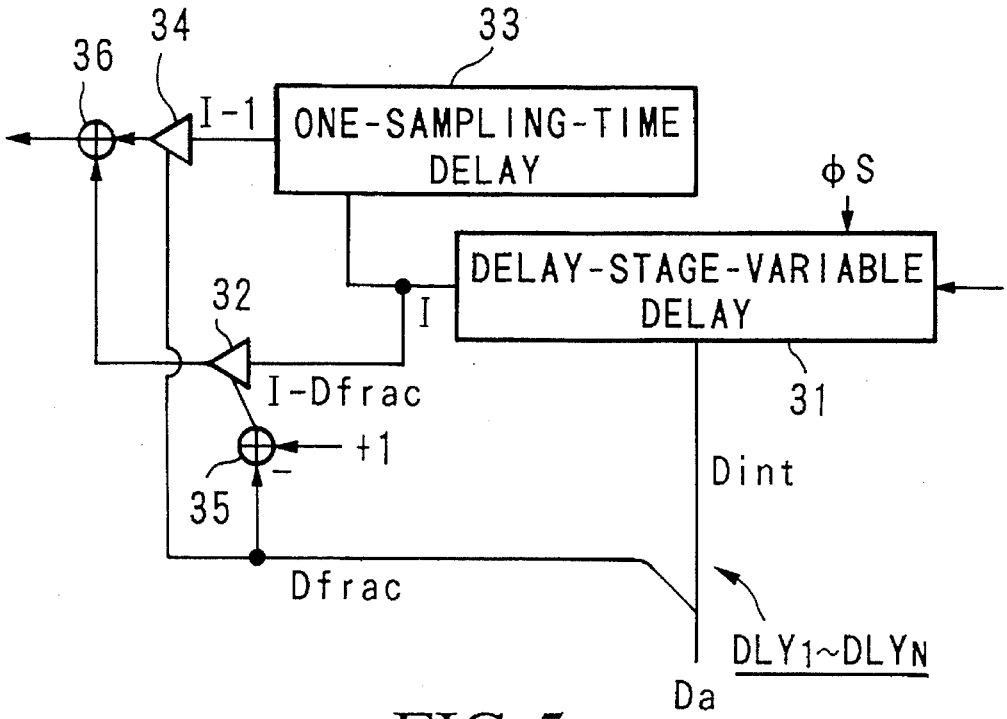
FIG. 5 is a block diagram showing a detailed configuration of an example of the delay circuit which can be employed in the second embodiment.
Figure 6:
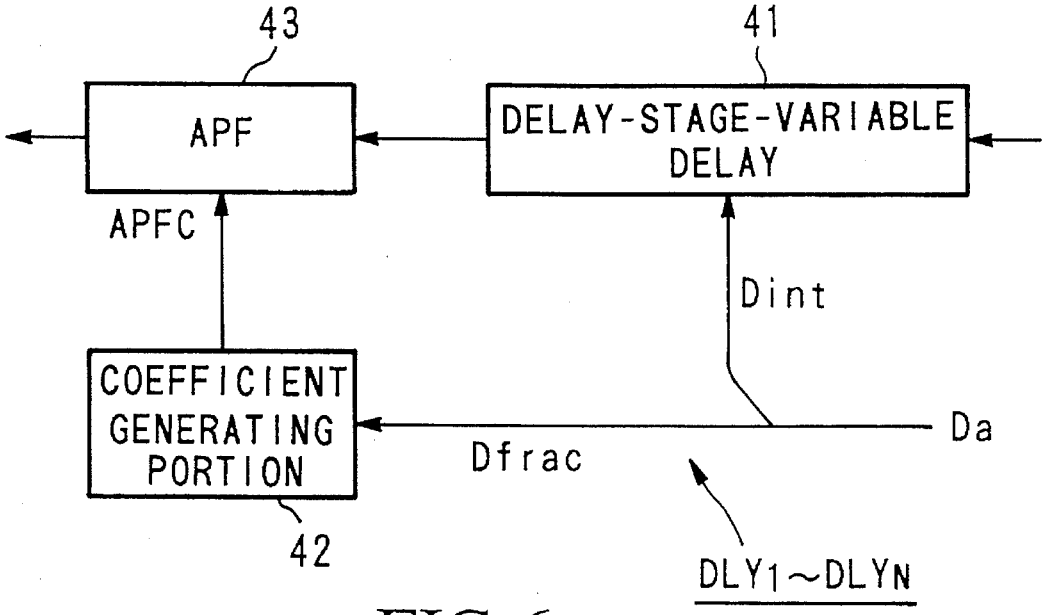
FIG. 6 is a block diagram showing a detailed configuration of another example of the delay circuit which can be employed in the second embodiment.

FIG. 4 is a block diagram showing a tone generator according to a second embodiment of the present invention. In the first embodiment, there is provided only one delay circuit DLY, so that the delay output selector SLT outputs the delayed musical tone signals. In contrast to the first embodiment, the second embodiment provides a plurality of delay circuits $DLY_1$ to $DLY_N$ respectively for the feedback paths $LT_1$ to $LT_N$. The delay circuits $DLY_1$ to $DLY_N$ receive delay-stage data $Da_1$ to $Da_N$ respectively, each of which is determined by the keycode KC and the like. Each of the delay circuits $DLY_1$ to $DLY_N$ is configured as shown in FIG. 5 or 6. In the configuration of FIG. 5, an integral part Dint of the delay-stage data Da is supplied to a delay-stage-variable delay circuit 31 as information which designates the delay time. The delay circuit 31 delays the input signal thereof by a delay time which is represented by "Dint*τ", where "τ" denotes the period of the sampling clock ϕs. An output signal of the delay circuit 31 is delivered to a multiplier 32 and a one-sampling-time delay circuit 33. The delay circuit 33 delays the input signal thereof by a certain delay time corresponding to one sampling period τ; and then, an output signal of the delay circuit 33 is supplied to a multiplier 34. In other words, the multiplier 32 receives current data I, while the multiplier 34 receives previous data $I_{-1}$ which is delayed behind the current data I by one sampling period τ. The multiplier 34 multiplies the previous data $I_{-1}$ by a value of a decimal part Dfrac of the delay-stage data Da. A subtracter 35 subtracts the value of the decimal part Dfrac from "+1" so as to produce a value "1−Dfrac", which is supplied to the multiplier 32 as its multiplication coefficient. Hence, the multiplier 32 multiplies the current data I by the value "1−Dfrac". Thereafter, results of multiplication of the multipliers 32 and 34 are added together by an adder 36.

In the configuration of FIG. 6, the integral part Dint is supplied to a delay-stage-variable delay circuit 41, while the decimal part Dfrac is supplied to a coefficient generating portion 42. Based on the value of the decimal part Dfrac, the coefficient generating portion 42 generates a coefficient APFC which designates the phase characteristic for an all-pass filter 43. An output signal of the delay circuit 41 is supplied to the all-pass filter 43. The all-pass filter 43 alters the phase of the input signal thereof on the basis of the coefficient APFC.

In the tone generator according to the present invention, the number of the feedback paths provided in the closed loop is determined responsive to the number of strings provided in the acoustic musical instrument such as the guitar or the piano.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A tone generator for an electronic musical instrument comprising:

excitation means for generating an excitation signal; and closed-loop means for circulating said excitation signal therein, said closed-loop means including:

addition means for adding a plurality of signals;

a plurality of feedback paths, each feedback path including delay means for delaying a feedback signal in said feedback path by a specified delay time, and signal processing means for processing said feedback signal; and delay ratio control means for controlling the delay time in each of said plurality of feedback paths in accordance with a delay ratio, wherein said excitation signal is applied to said closed-loop means and is transmitted through each of said plurality of feedback paths to produce a corresponding plurality of feedback signals, said plurality of feedback signals being added together with said excitation signal by said addition means, whereby an output signal of said addition means is extracted as a musical tone signal.

2. A tone generator as defined in claims 1 wherein said signal processing means, provided in each of said plurality of feedback paths, includes a filter.

3. A tone generator as defined in claim 2 wherein said signal processing means further includes an all-pass filter.

4. A tone generator for an electronic musical instrument, comprising:

excitation means for generating an excitation signal;

a closed loop circuit for circulating said excitation signal therein, said closed loop circuit including at least two feedback paths, each of which includes a delay circuit and an all-pass filter connected together in a cascade-connection manner, said excitation signal being provided to said plurality of feedback paths in said closed loop circuit;

delay-ratio control means for controlling a ratio between delay times of said delay circuits provided in said feedback paths in accordance with a designated delay ratio; and addition means for adding output signals from each of said feedback paths and said excitation signal to produce a musical tone signal.

5. A tone generator as defined in claim 4 wherein said delay ratio is designated by using integral numbers which are arbitrarily set.

6. A tone generator for an electronic musical instrument, comprising:

drive-waveform generating means for generating a drive-waveform signal by mixing an excitation waveform and a noise waveform;

a closed loop circuit for circulating said drive-waveform signal, said closed loop circuit including a plurality of feedback paths, each of which includes a delay circuit and an all-pass filter, wherein delay times of said delay circuits provided in said plurality of feedback paths are selectively controllable, said drive-waveform signal being provided to said plurality of feedback paths in said closed loop circuit;

delay-stage designating means for designating a number of delay stages, representing an amount of delay, for each of said delay circuits provided in said plurality of feedback paths; and mixing means for mixing output signals from each of said feedback paths with said drive-waveform signal to produce a musical tone signal.

7. A tone generator as defined in claim 6 wherein said delay-stage designating means includes means for computing the number of delay stages in response to an arbitrarily set delay ratio.

* * * * *